US007344234B2

(12) United States Patent
Merz et al.

(10) Patent No.: US 7,344,234 B2
(45) Date of Patent: Mar. 18, 2008

(54) PRINT HEAD PRESSURE CONTROL ARCHITECTURES

(75) Inventors: Eric A Merz, Palmyra, NY (US); Brian S Hilton, Rochester, NY (US); Kazuyuki Oda, Toda (JP); Takatoshi Tsuchiya, Fujisawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 318 days.

(21) Appl. No.: 10/760,593

(22) Filed: Jan. 21, 2004

(65) Prior Publication Data

US 2005/0157129 A1 Jul. 21, 2005

(51) Int. Cl.
*B41J 2/175* (2006.01)

(52) U.S. Cl. ..... 347/87

(58) Field of Classification Search ..... 347/86, 347/87, 85

See application file for complete search history.

(56) References Cited

U.S. PATENT DOCUMENTS 4,920,362 A * 4/1990 Cowger ..... 347/87
5,182,579 A 1/1993 Haruta et al.
5,420,625 A 5/1995 Dietl et al.
5,971,531 A 10/1999 Dietl et al.
6,398,353 B1 * 6/2002 Tsuchii ..... 347/86
6,698,871 B1 * 3/2004 Hayashi et al. ..... 347/86
6,773,097 B2 * 8/2004 Dowell ..... 347/85

FOREIGN PATENT DOCUMENTS

EP 0 956 959 A2 11/1999
KR 2001045304 A * 11/1999

OTHER PUBLICATIONS

U.S. Appl. No. 10/747,396, filed Dec. 30, 2003, Hilton et al.

* cited by examiner

*Primary Examiner*—Anh T. N. Vo
(74) *Attorney, Agent, or Firm*—Oliff & Berridge, PLC

(57) ABSTRACT

A fluid container, such as, for example, an inkjet print head cartridge, architecture uses a relatively large filter that is located below a negative pressure material chamber and a free ink chamber in a side-by-side relationship. The negative pressure material volume relative to a free ink chamber value can me made to be approximately one to one. Both chambers overlie an ink manifold/delivery port and are separated from the delivery port by a filter. Flow impedance of the cartridge is reduced, as a result, in any orientation of the cartridge. The filter may be separated from, or in contact with a negative pressure material. A cartridge lid is provided with a negative pressure material chamber which is suspended into the cartridge. A negative pressure material having a fiber felt construction is provided.

13 Claims, 3 Drawing Sheets

PRINT HEAD PRESSURE CONTROL ARCHITECTURES

BACKGROUND OF THE INVENTION

1. Field of Invention

This invention is directed to controlling pressure at the print head of an inkjet marker.

2. Description of Related Art

Typically, fluid pressure of an inkjet print head is maintained within a tightly controlled range. A negative pressure is usually maintained in an ink tank which is connected to an inkjet print head in order to prevent ink from weeping out of the openings or nozzles of the print head. One conventional method for accomplishing such a negative pressure uses a capillary medium, such as, for example, foam. However, the use of a negative pressure or capillary material, such as, for example, a foam, has a number of drawbacks.

For example, the volumetric efficiency of an ink tank container is reduced by the amount of space which is occupied by the foam or other negative pressure material. Additionally, under relatively high ink flow conditions, the foam or other negative pressure material may create an impedance that raises the negative pressure to relatively unacceptable values, which in turn slows the fluid refill of the inkjet print head nozzles, and may, under certain circumstances, create a "starved jet" condition, i.e., one in which ink is not supplied to the print head in sufficient volume for proper inkjet print head operation. Also, the foam or other negative pressure material in an ink tank is typically only partially saturated and contains a mixture of air and ink which may make it difficult under certain circumstances to prevent a "de-prime" condition. A de-prime condition involves delivery of air out of the foam before useable ink is drained from the foam. Additionally, a foam negative pressure/capillary element may have particles contained therein that may clog inkjet nozzles if the particles reach the inkjet nozzles of a print head.

To address the volumetric efficiency problem, some print heads use a multi-chamber "bubble" design. For example, U.S. Pat. No. 5,182,579 and European Patent 956,959 are examples of bubble design multi-chamber print heads. Multi-chamber bubble design print heads typically have one chamber containing a negative pressure medium, e.g., foam, and other chambers containing only ink. The other chambers which contain ink (and air as the ink is depleted) may be referred to as free ink chambers and are in fluid contact with respect to the negative pressure/capillary medium, e.g., foam, chamber typically through a small opening between the chambers. Ink is withdrawn from the ink tank and provided to a print head by being withdrawn from the chamber with the negative pressure material. Flow of ink between the free ink chamber through the manifold and to the print head, and is pressure controlled as a result of this flow configuration. As ink is depleted from the negative pressure/capillary medium, air enters the inkjet cartridge through a vent, which is typically located above the negative pressure/capillary material. The multi-chamber bubble design ink tank architecture does not, however, solve de-prime or impedance problems mentioned above.

One way to improve the de-prime issue is to drain ink from the ink tank to the print head out of a free ink chamber, not out of a negative pressure/capillary, e.g., foam, chamber. This architecture reduces the de-prime problem, but due to a relatively small area of the opening between the negative pressure/capillary, e.g., foam, material and the free fluid/ink chamber, a relatively high impedance still exists under high flow conditions.

The aforementioned de-prime solution architecture also is not very robust with respect to environmental changes such as, for example, high temperature, and/or low-pressure. For example, when the ink tank temperature is increased or its barometric pressure is increased, any air trapped in the free ink chamber, which typically exists during the mid-life of an inkjet print head and ink tank, will increase/expand in the free ink chamber. This expansion will tend to displace ink and supersaturate the negative pressure material, such as, for example, foam. This super saturation may result in either a positive pressure in the print head and, consequently, weeping of fluid from the nozzles in the print head, and/or the fluid overflowing the foam and causing fluid to leak through the vent opening of the inkjet cartridge, typically located above the foam.

A refillable fluid container system having a pressure control architecture in which persistent air bubbles are released from a capillary or foam fluid reservoir and are directed from an optical level sensing system in a liquid fluid reservoir with which the systems and methods of this invention may be employed is disclosed in copending U.S. patent application Ser. No. 10/747,396, the subject matter of which is hereby incorporated by reference in its entirety.

SUMMARY OF THE INVENTION

In various exemplary embodiments of the systems and methods according to this invention, a ratio of from about 0.3 to 1 to about 3.0 to 1, preferably from about 0.5 to 1 to about 2 to 1, and more preferably from about 1 to 1 is achieved between the volume of an inkjet tank/cartridge negative pressure medium chamber and the volume of the free ink chamber. In various exemplary embodiments, this is achieved by locating a part of the negative pressure medium chamber above a filter which is located in the cartridge. The systems, devices and methods according to this invention separately improve the robustness of an inkjet tank/cartridge to environmental changes.

Various exemplary embodiments of the systems and devices and methods according to this invention separately provide an ink tank and/or ink cartridge architecture which uses a relatively large fluid particulate filter that is partially in contact with the negative pressure element. In various exemplary embodiments, because the negative pressure/capillary material is placed vertically above, or overhangs, the filter in the ink tank or ink cartridge, a relatively optimal foam volume to free ink volume ratio of approximately from about 0.3 to 1 to about 3.0 to 1, preferably from about 0.5 to 1 to about 2 to 1, and more preferably from about 1 to 1 can be achieved.

In various exemplary embodiments, the negative pressure/capillary medium is a foam. In other exemplary embodiments, the medium may be a non-woven material such as, for example, felt.

Various exemplary embodiments of the systems, devices and methods according to this invention separately provide a relatively large area of contact between a negative pressure material and a filter where the density of the negative pressure material in contact with the filter has a relatively low value adjacent to the filter to reduce flow impedance of ink from the inkjet container or cartridge.

Various exemplary embodiments of the systems, devices and methods according to this invention separately provide a relatively large area of a negative pressure material over an inkjet print head cartridge ink discharge port and/or ink discharge manifold to reduce flow impedance of ink from the inkjet container or cartridge.

The invention separately provide contact between the negative pressure material and the filter in the ink tank or ink cartridge that is directly contacting or spaced above only a portion of the filter so that there is both an area for the negative pressure material to contact the filter and there is a relatively large area for the ink to flow through the filter area with respect to which the negative pressure material does not contact with relatively low impedance.

Various exemplary embodiments of the systems, devices and methods according to this invention separately provide an ink tank container and/or cartridge wherein the negative pressure material contacts a portion of the surface of a filter in the ink tank container and/or cartridge, so that the ink which passes through the filter is drained directly from the free ink tank chamber, and not directly from a negative pressure material chamber.

In various exemplary embodiments of the ink tank construction according to this invention, the pressure controlled performance of an inkjet print head is improved at relatively high ink flow rates with a relatively simple static pressure control arrangement, thereby reducing any problem with starved inkjet nozzles, without the need to employ relatively complex dynamic pressure control systems.

Various exemplary embodiments of the systems, devices and methods according to this invention also reduce "de-prime" problems that may be associated with delivery of ink from an ink reservoir chamber via a negative pressure material chamber.

Various exemplary embodiments of the systems, devices and methods according to this invention separately provide an inkjet print head cartridge or tank architecture in which a negative pressure material chamber is suspended directly or indirectly from an ink tank element into a free ink chamber.

Various exemplary embodiments of the systems, devices and methods according to this invention separately provide a negative pressure material chamber as part of the lid assembly of an inkjet marker ink tank chamber and/or cartridge.

Various exemplary embodiments of the systems, devices and methods according to this invention separately provide one or more spacers such as, for example, capillary elements, to separate at least one negative pressure element(s) and an ink tank discharge manifold.

Various exemplary embodiments of the systems, devices and methods according to this invention separately provide one or more spacers, such as, for example, capillary elements, to achieve a variable separation between at least one negative pressure element(s) and an ink tank discharge manifold.

Various exemplary embodiments of the systems, devices and methods according to this invention separately provide one or more spacers, such as, for example, capillary elements, to achieve a desirable amount of fluid contact between at least one negative pressure element(s) and an ink tank discharge manifold.

Various exemplary embodiments of the systems, devices and methods according to this invention separately provide inkjet print head fluid container arrangements with different configurations that vary negative pressure material chamber locations and/or negative pressure media characteristics depending upon the pressure control that is desired for an individual fluid container.

Various exemplary embodiments of the systems, devices and methods according to this invention separately provide improved ink tank assembly processing by allowing different print heads with different pressure regulation characteristics to be manufactured on the same assembly line.

Various exemplary embodiments of the systems, devices and methods according to this invention separately provide an inkjet print head cartridge configuration which permits ink to be directly provided to the print head solely from a free ink chamber.

Various exemplary embodiments of the systems, devices and methods according to this invention separately provide a marking or other fluid container configuration which exposes the entire base of a capillary media chamber to a filter located in and/or above a manifold into which a marking fluid or other fluid, such as, for example, a cleaning fluid, is delivered from a free fluid chamber located within the fluid container, thereby minimizing pressure drop in an inkjet print head cartridge.

Various exemplary embodiments of the systems, devices and methods according to this invention separately provide placing bubblers/bubble chambers on multiple sides of a negative pressure material chamber in an ink tank to modify and modulate pressure loss in the ink tank.

Various exemplary embodiments of the systems, devices and methods according to this invention separately provide a non-woven material such as, for example, felt, as a negative pressure or capillary medium in conjunction with a print head in which ink is pulled out of a free ink chamber as contrasted with an ink tank where ink is pulled out or drained directly from the negative pressure medium chamber.

Various other features and advantages of the systems and methods according to this invention will become apparent upon review of the exemplary embodiments described herein.

BRIEF DESCRIPTION OF THE DRAWINGS

Various exemplary embodiments of this invention will be described in detail, with referenced to the following figures, wherein:

FIG. 3, including FIGS. 3B and 3C illustrate manufacturing steps for manufacturing alternative liquid containers of a type shown in FIG. 3A, having alternative lid configurations.

DETAILED DESCRIPTION OF EXEMPLARY EMBODIMENTS

The following detailed description of various exemplary embodiments of the fluid containers usable with fluid ejection systems or other technologies that store and consume fluids, according to this invention may refer to one specific type of fluid ejection system, e.g., an inkjet printer that uses the refillable fluid containers according to this invention, for sake of clarity and familiarity. As applied herein, fluids refer to non-vapor (i.e., relatively incompressible) flowable media, such as liquids, slurries and gels. However, it should be appreciated that the principles of this invention, as outlined and/or discussed below, can be equally applied to any known or later-developed fluid ejection systems, beyond the ink jet printer specifically discussed herein. In addition, it should be appreciated that the principles of this invention can also be applied to other fluid containing systems in which ventilation is required. Such fluid-ejection applications include, but are not limited to, ink-jet printers, fuel cells, dispending medication, pharmaceuticals, photo results and the like onto a receiving medium, injecting reducing agents into engine exhaust to control emissions, draining condensation during refrigeration, etc.

Figure 1:
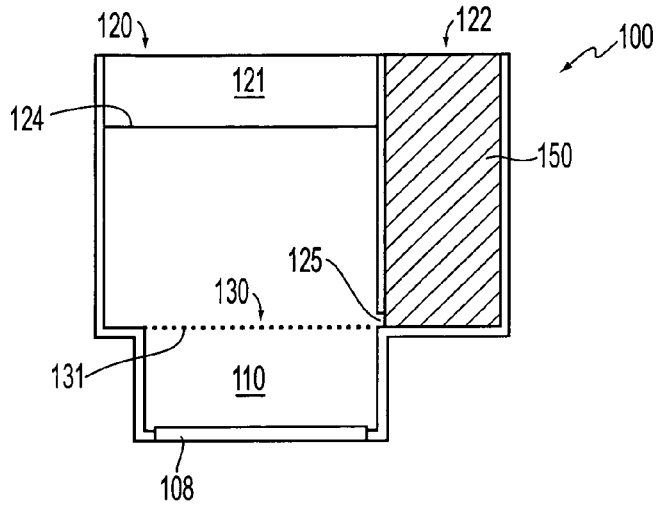
FIG. 1 is a cross-sectional view of an exemplary ink tank with a free ink chamber from which ink is delivered to a print head and a negative pressure chamber wherein the chambers are connected by a relatively small fluid connection opening.

FIG. 1 is a cross-sectional view of an inkjet print head cartridge 100 which includes a free ink chamber 120, a negative pressure material chamber 122 and an air space 121 located above ink level 124, a fluid connection opening 125, a fluid deliver opening 130, a filter 131 located across all or part of the fluid delivery opening 130 and a printing die/print head 108. One advantage of this configuration is that the ink which is drained from the ink tank 100 is provided to a print head, also commonly referred to as a printing die 108, by being drained out of a free ink chamber 120 instead of being drained directly from the negative pressure material chamber 122. This architecture reduces the chances of a "de-prime" situation occurring at the printing die/print head 108. However due to the relatively small area of the opening 125 between the negative pressure material 150 and the free ink 124 in the free ink chamber 120 of the ink tank or cartridge 100, it has a relatively high impedance at relatively high fluid flow conditions.

The ink tank 100 shown in FIG. 1 is also susceptible to expansion of air located in the free ink chamber 120 when the ambient temperature is raised or the ambient barometric pressure is increased. The expanded air typically will displace ink, super saturate the negative pressure material 150, and may result in either a positive pressure in the printing die head 108 and consequently possibly weeping from the ink jets, or overflow of fluid from the negative pressure material 150 which may result in fluid leaking out of the cartridge.

In order to improve the robustness of the ink tank shown in FIG. 1 with respect to environmental changes, according to exemplary embodiments of the invention, a ratio of from about 0.3 to 1 to about 3.0 to 1, preferably from about 0.5 to 1 to about 2 to 1, and more preferably from about 1 to 1 is provided between the volume of the negative pressure chamber 122 to the volume of the free ink chamber 120. This may be achieved, for example, by locating the negative pressure material 150 in contact with, or above, a portion of filter 131. Applicants have found that ink tanks having such ratios of about 0.3 to 1 have good volumetric efficiency but their leak characteristics are not as good as ink tanks with higher ratios, and that ink tanks having such ratios of about 3 to 1 are very robust with respect to leakage but not as volumetrically efficient as ink tanks with lower ratios. Thus, ratios between these extremes have been found to be a good compromise.

Figure 2:
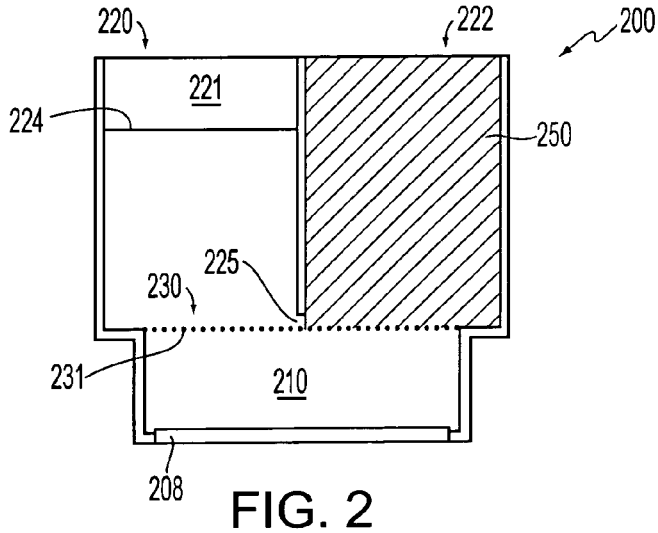
FIG. 2 is a cross-sectional view of a first exemplary embodiment of an ink tank according to this invention.

In a first exemplary embodiment according to this invention, as shown in FIG. 2, an inkjet print head cartridge or ink tank 200 has a relatively large manifold opening 230 as well as a ratio of the volume of the free ink chamber 220, which has an air space 221 above ink level 224, and the negative pressure medium chamber 222 of about 0.3 to 1 to about 3.0 to 1, preferably about 1:1. This results in a relatively increased volume of the negative pressure material 250 which permits the negative pressure material 250 to be able to absorb relatively more displaced ink than if the negative pressure material 250 were not located over a portion of the manifold 210 and/or the filter 231.

A ratio of about 1.1 or higher between the volume of the negative pressure material chamber 222 to the volume of the free ink chamber 220, which is suitable to accommodate reasonable environmental changes, is difficult to achieve in some existing inkjet print head cartridges due to mold manufacturing concerns, and space constraints. Because the negative pressure material 250 is above, or overhangs, the filter 231, a relatively optimal negative pressure material volume to free ink volume ratio of approximately one to one may be achieved using conventionally sized inkjet print head cartridges.

In the first exemplary embodiment of FIG. 2, the ink tank architecture uses a relatively large filter 231 that is located below a portion of the negative pressure material 250. The negative pressure material 250 can be located in contact with the filter 231 and/or be separated from the filter 231. Both configurations result in improved pressure characteristics. In the situation where the negative pressure material 250 is separated from the filter 231, ink flows from the negative pressure material 250 across the entire cross sectional area of the bottom of the negative pressure material 250 and into the manifold 210 below the free ink chamber 220. The cross-sectional area of the interface between the negative pressure material 250 and the free ink tank chamber 220 is substantially larger than in the embodiment illustrated in FIG. 1, for example. In both instances, the ink that is directed to the print head 208 through manifold 210 is directed directly to the manifold 210 from the free ink chamber 220.

Applicants have found that the larger the surface area of the negative pressure material exposed to the ink tank manifold, the lower the impedance of the negative pressure material to flow of ink into the manifold.

Moreover, the capillary nature of the filter 231 may serve to improve fluid contact to the negative pressure material 250 at any orientation of the ink tank/cartridge 200, thereby making the ink tank/cartridge 200, which may include the printing dye/print head 208, more robust with respect to environmental temperature and pressure changes.

As shown in FIG. 2, only a portion of the filter 231 lies directly below, in contact with or separated from, the negative pressure material 250, so that there is both an area of the filter 231 which contacts the negative pressure material 250 and there is another relatively large area of the filter 231 for the ink to directly flow through from the free ink chamber 220 to the print head 208 via the manifold 210 with relatively low impedance. In the first exemplary embodiment, the performance of the ink tank/cartridge 200 is relatively more robust to environmental changes and has better pressure regulation aspects then does the exemplary embodiment shown in FIG. 1.

Embodiments such as the first exemplary embodiment shown in FIG. 2: (a) improve pressure control performance of the ink tank/cartridge 100 at relatively high fluid flow rates, thereby reducing the chances of a "starved inkjet" problem; (b) reduce the chance that a de-prime situation will arise because the fluid is not being pulled directly out of the negative pressure material; and (3) improve ink delivery efficiency while maintaining robustness with respect to environmental changes such as, for example, temperature and pressure changes.

Figure 3A:
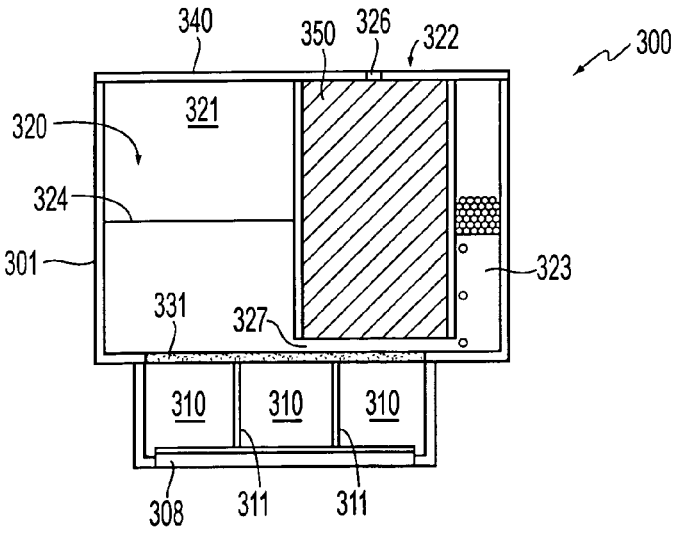
FIGS. 3A-3C, is a cross-sectional view of one exemplary embodiment of a second exemplary embodiment of an ink tank according to this invention, where
Figure 3B:
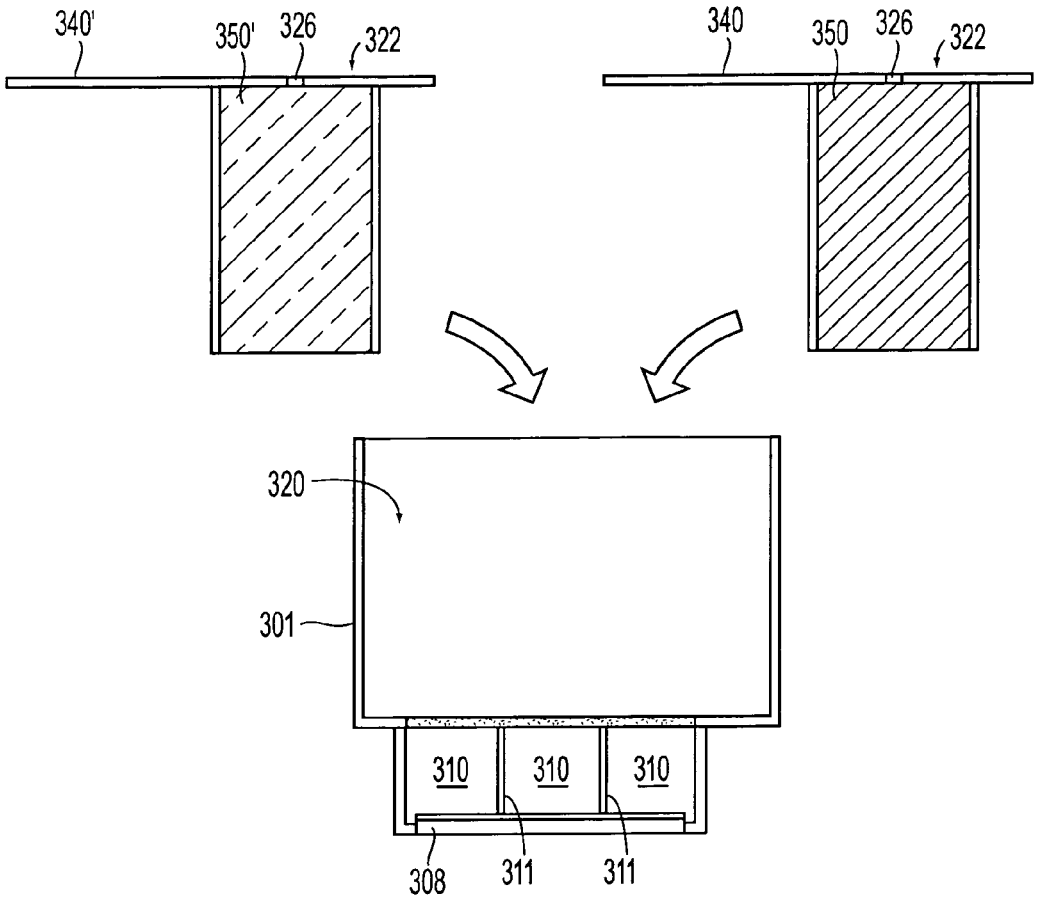
Figure 3C:
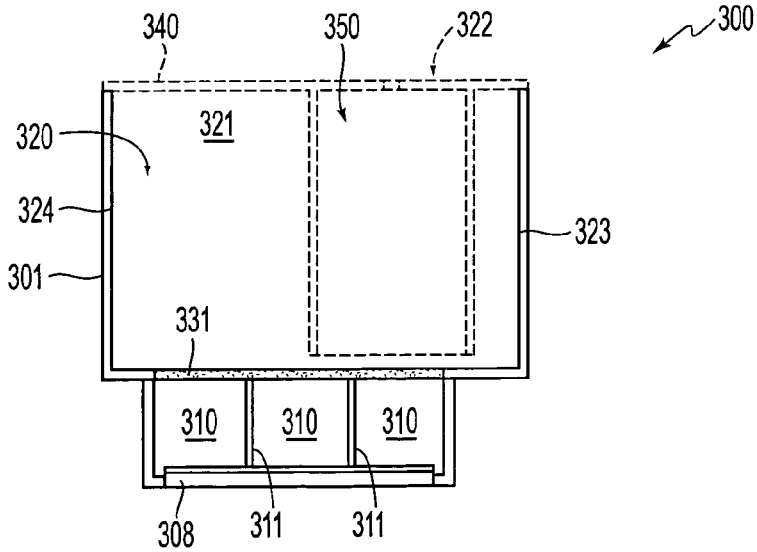

In a second exemplary embodiment shown in FIG. 3 (including FIGS. 3A-3C), an inkjet print head cartridge or ink tank 300 has an architecture wherein a separate negative pressure material chamber 322 is suspended into the free ink chamber 320, which has an air space 321 above ink level 31, from a separate element 340 which, for example, may be a lid 340 of the ink tank/cartridge 300. In exemplary embodiments of this invention, the negative pressure material chamber 322 is part of the lid 340 that is attached to the ink tank/cartridge 300.

As shown in FIG. 3, the ink tank 300 has a body 301, a number of chambers including a free ink chamber 320, a negative pressure material chamber 322, an ink bubbling chamber 323, an ink manifold chamber 310, and a lid 340. The lid 340 may include with a vent 326, for example, in communication with the negative pressure material chamber 322. In the second exemplary embodiment shown in FIG. 3, the distance between the negative pressure chamber walls and the print head ink chamber walls may be controlled and one or more separate ink bubble chambers 323 may be provided to control the size of bubbles remaining in the free ink chamber 321. A space 327 may separate negative pressure material 350 from filter 331.

The second exemplary embodiment shown in FIG. 3 has extremely flexible and modular elements. Because different products in a family of inkjet print head products have different needs, including different product regulation needs, the second exemplary embodiment permits use of the same print head body with different lid configurations to increase or decrease the size or shape of the negative pressure material 350 and/or to change various characteristics of the negative pressure material 350, depending upon the particular pressure regulation needs of a given product.

Referring to FIGS. 3A-3C, the second exemplary embodiment also permits different lid configurations to be manufactured and the entire inkjet print head assembly to be assembled on the same assembly line because the last step in the assembly process may be attaching the lid. Thus, it is possible to fit a single type of ink (or other fluid) tank body 301 with one of two or more separate lids 340, 340' and/or one or more of two types of negative pressure materials 350,350' thereby achieving different ink (fluid) tanks 300 merely by providing a desired one of multiple types of lids 340 and one of multiple types of negative pressure materials 350 for a particular type of ink (fluid) tank body 301.

In various exemplary embodiments, multiple inkjet bubbling chambers may be placed on one or more sides of the negative pressure material chamber 322 to modify the pressure loss in the ink tank 300.

Figure 4:
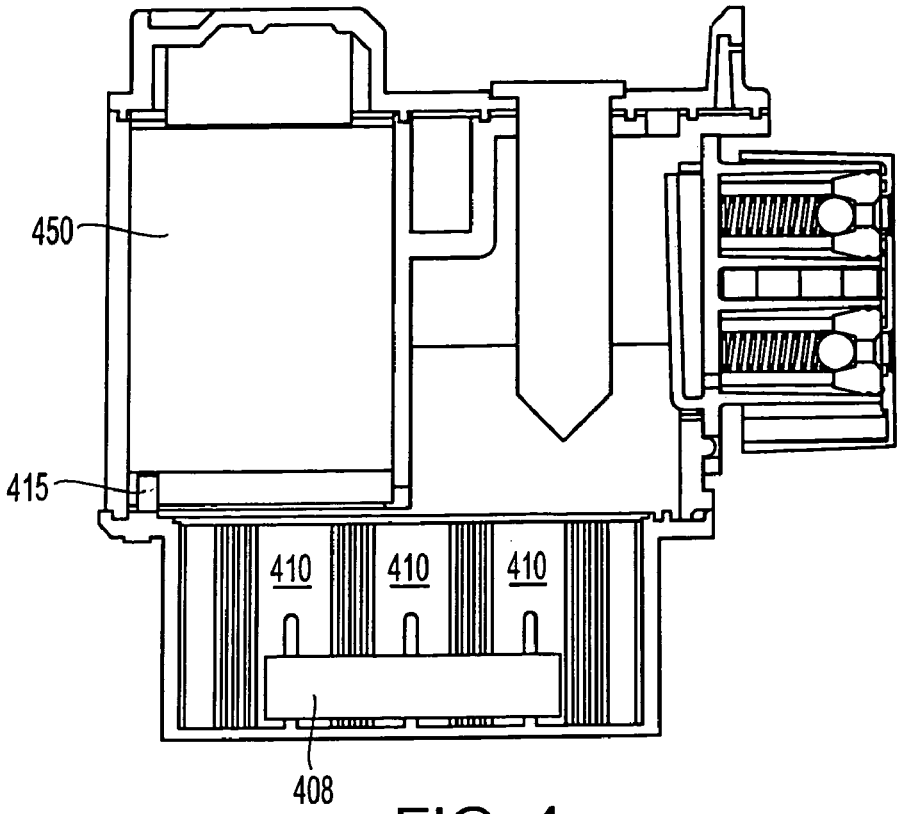
FIG. 4 is a cross-sectional view of one exemplary embodiment of a third exemplary embodiment of an ink tank according to this invention.

FIG. 4 shows a third exemplary embodiment of this invention in which the amount of separation between the negative pressure material 450 and the manifold 410 (with or without a filter) is in the form of one or more capillary elements, such as, for example, ribs 415, which permit and maintain fluid contact between the ink in the reservoir, including the negative pressure material 450, and the manifold 410, and the print head die 408, which may be, for example, in modular form.

Figure 5:
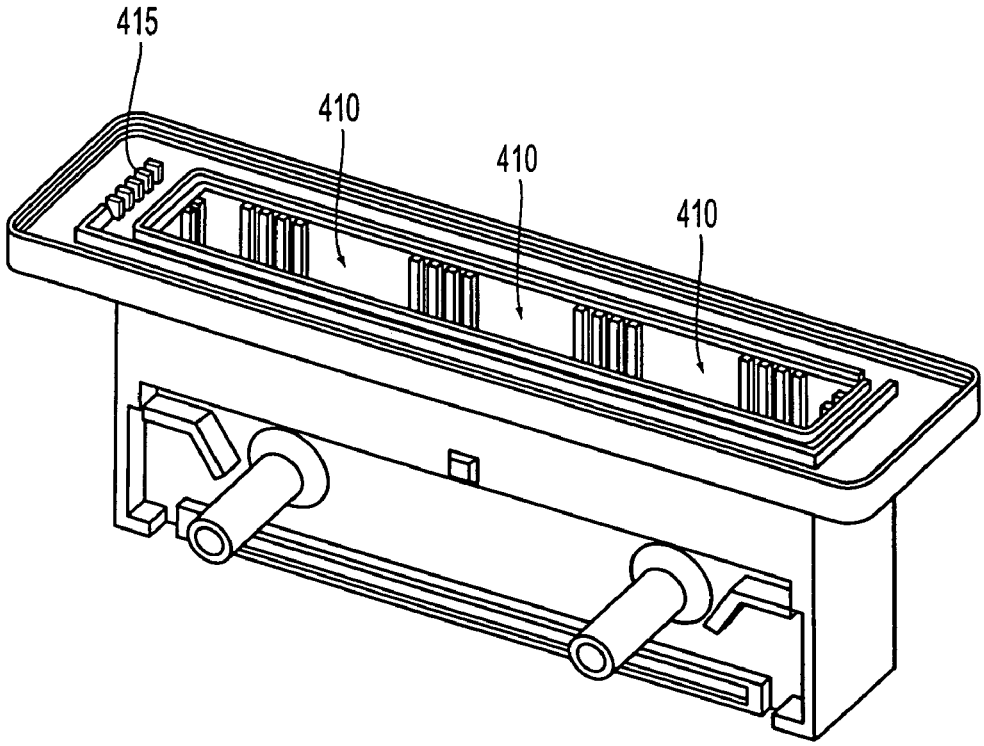
FIG. 5 is a perspective view of a fourth exemplary embodiment of an ink tank manifold according to this invention with capillary ribs.

FIG. 5 shows a perspective view of a fourth exemplary embodiment of a print head ink tank manifold with capillary ribs 415. The various dimensions, including, the shape, thickness and height, and the number of the capillary ribs 415 may vary and be selected, for example; to achieve desired ink flow rates to reduce the occurrence of starved inkjet print head conditions and/or the occurrence of deprime conditions, and/or to maintain maximum ink delivery efficiency while minimizing the influence of environmental conditions on the ink flow characteristics of the print head. Although a plurality of capillary ribs 415 is shown in FIGS. 4 and 5, it is understood that only one capillary rib need be provided, and that the ribs 415 may be part of the manifold 410 or separate therefrom, and/or part of, or otherwise contacting, the negative pressure material. In various exemplary embodiments of the invention, the capillary ribs 415 may be formed as an extension of the negative pressure material 450. In such an exemplary embodiment, the capillary rib extension may be completely or partially made of, and/or coated with, a material which does not absorb fluid (including ink fluid). In one exemplary embodiment, where only one capillary rib is used, the side walls of the capillary opening may be varied as desired to provide suitable support to the negative pressure material. Moreover, in various exemplary embodiments of the invention, capillary ribs 415 may be located as part of and/or connect with, different parts of the ink tank, including the manifold 410, the filter and the negative pressure material 450.

In any of the aforementioned embodiments of the invention, which are shown, for example, in FIGS. 1-5, the negative pressure or capillary material may be a non-woven material such as, for example, felt. Felt has been found to have a number of advantages with respect to foam. Foam is an inherently randomly structured material with a relatively random distribution of pores and pore shapes. Foam also often has a directional capillary preference in one direction or another. However, fiber felt is a more orderly and quite directionally oriented material with respect to foam. A felt typically has a fiber grain direction, a cross-grain direction, and a "needling" direction. Along the fiber grain direction, the felt has a relatively high capillarity, and a medium flow resistance. Along the cross-gram direction the felt has a relatively moderate capillarity and relatively high flow resistance. Along the needling direction, the felt has a relatively low capillarity and a relatively flow resistance for liquids. By orienting a felt properly, typically with the grain direction aligned vertically when the ink cartridge is in operation, a print head can be optimized with respect to capillarity, flow resistance, and ink delivery efficiency. Also, by optimizing fiber size, denier, and needle size, the performance of the print head may be fine tuned. Examples of suitable non-woven materials, including polyester felts, and specific characteristics of such materials can be found in U.S. Pat. Nos. 5,420,625 and 5,971,531 to Dietl et al., the subject matter of which is hereby incorporated by reference in its entirety.

While this invention has been described in conjunction with the exemplary embodiments outlined above, it is evident that many alternatives, modifications and variations will be apparent to those skilled in the art. Accordingly, the exemplary embodiments of the invention as set forth above, are intended to be illustrative, and not limiting. Various changes may be made without departing from the spirit and scope of the invention.

What is claimed is:

1. A fluid container for a fluid marker having a print head, comprising:

a fluid container body with a free fluid reservoir located in side-by-side relationship with a negative resistance material containing chamber and fluidly connected to the negative resistance material containing chamber;

a common fluid delivery port opening into the fluid container and directly connecting the free fluid reservoir and the negative resistance material containing chamber with the print head to deliver fluid to the print head directly from at least the free fluid reservoir; and at least one bubble chamber located within the fluid container, wherein the negative resistance material containing chamber is located between the free fluid reservoir and the bubble chamber, and wherein the bubble chamber and the free fluid reservoir are connected by a passage that bypasses the negative resistance material containing chamber.

2. The fluid container of claim 1, wherein a ratio of the volume of the free fluid reservoir to the volume of the negative resistance material containing chamber is between about 0.3 to 1 and about 3.0 to 1.

3. The fluid container of claim 2, wherein the ratio is between about 0.5 to 1 and about 2 to 1.

4. The fluid container of claim 3, wherein the ratio is about 1 to 1.

5. The fluid container of claim 1, wherein the negative resistance material is made of felt.

6. The fluid container of claim 1, wherein the negative resistance material is a non-woven material.

7. The fluid container of claim 1, further comprising at least one capillary element located between the negative resistance material and the fluid delivery port.

8. The fluid container of claim 7, wherein the at least one capillary element comprises at least one rib.

9. The fluid container of claim 7, wherein the at least one capillary element is connected to the negative resistance material.

10. The fluid container of claim 7, wherein the at least one capillary element is connected to the fluid delivery port.

11. The fluid container of claim 1, further comprising at least one manifold rib located in the fluid delivery port to space the negative resistance material from the fluid delivery port.

12. The fluid container of claim 1, further comprising a porous element located in the delivery port opening to support at least one of the free ink chamber and the negative resistance material chamber.

13. The fluid container of claim 1, wherein the fluid container has a lid and the negative resistance material containing chamber is attached to the lid.

* * * * *